US005910202A

United States Patent [19]

DeMarc

[11] Patent Number: 5,910,202

[45] Date of Patent: Jun. 8, 1999

[54] ROTARY CUTTER

[76] Inventor: Frank DeMarc, 156 Hardenburg La., East Brunswick, N.J. 08816

[21] Appl. No.: 08/792,558

[22] Filed: Jan. 31, 1997

[51] Int. Cl.[6] ..... B26D 3/10

[52] U.S. Cl. ..... 83/522.15; 83/588; 83/591; 30/300; 408/112; 408/186; 408/204

[58] Field of Search ..... 30/310, 500, 130, 30/300, DIG. 7; 83/582, 588, 591, 594, 595, 596, 522.15, 522.18, 663, 677; 408/112, 186, 204

[56] References Cited

U.S. PATENT DOCUMENTS

| | | | |
|---|---|---|---|
| 2,546,292 | 3/1951 | Bell | 30/310 X |
| 3,365,988 | 1/1968 | Karlan | 30/310 X |
| 4,547,966 | 10/1985 | Eden | 30/500 X |
| 4,548,118 | 10/1985 | Brosch | 83/591 X |
| 4,593,467 | 6/1986 | Safar | 30/310 X |

*Primary Examiner*—Clark F. Dexter
*Attorney, Agent, or Firm*—Thomas R. Farino, Jr.

[57] ABSTRACT

A rotary cutter for cutting holes of various sizes in ceiling tile in connection with the installation of light fixtures. The cutter includes an enclosure which functions as a jig for receiving and accurately positioning tile members prior to the cutting operation. The lower portion of this enclosure functions as a waste receptacle following the cutting operation. A drive shaft turns a pair of arms bearing two cutter knives for rotation within the structure thus cutting holes in the ceiling tile. The cutting blades are biased upwards for returning to a non-cutting position upon completion of the cutting operation. The cutting knives are radially adjustable along the arm on which they are mounted. A conventional electric drill is mounted to the other end of the drive shaft for imparting rotary motion to the blade arm.

2 Claims, 2 Drawing Sheets

ROTARY CUTTER

BACKGROUND OF THE INVENTION

1. Field of the Invention

The present invention relates generally to power operated cutting tools, and more specifically such tools adapted to cutting a circle in a planar workpiece.

2. Description of the Related Art

Crafts persons frequently need to cut neat, circular holes in planar sheet material such as ceiling tiles for the installation of lighting fixtures. Various well-known tools are available for this purpose but, in most cases, involve at least a three step process of locating the center of the tile, marking a circle at the correct size and then cutting the hole with a saw. The subject invention accomplishes the above in one operation, can make the cuts at varying radii, can be adjusted quickly and easily, is safe and accurate to use and supports the work piece being cut.

SUMMARY OF THE INVENTION

The rotary cutter of the present invention is adapted to fulfill the above-stated need. It comprises a drive shaft that turns an arm bearing two cutter knives. An enclosure is provided which functions as a jig for properly positioning the ceiling tile piece and supporting the same during the cutting operation. The bottom portion of this enclosure functions as a waste receptacle following the cutting operation. The cutting arm is upwardly biased so that it engages a workpiece as it is cut and returns to its non-engagement position upon completion of the cutting operation. The knives are preferably radially adjustable along the arm. Conventional electric drill means are provided for parting rotary motion to the blade arm.

DRAWINGS

DETAILED DESCRIPTION OF PREFERRED EMBODIMENT

Figure 1:
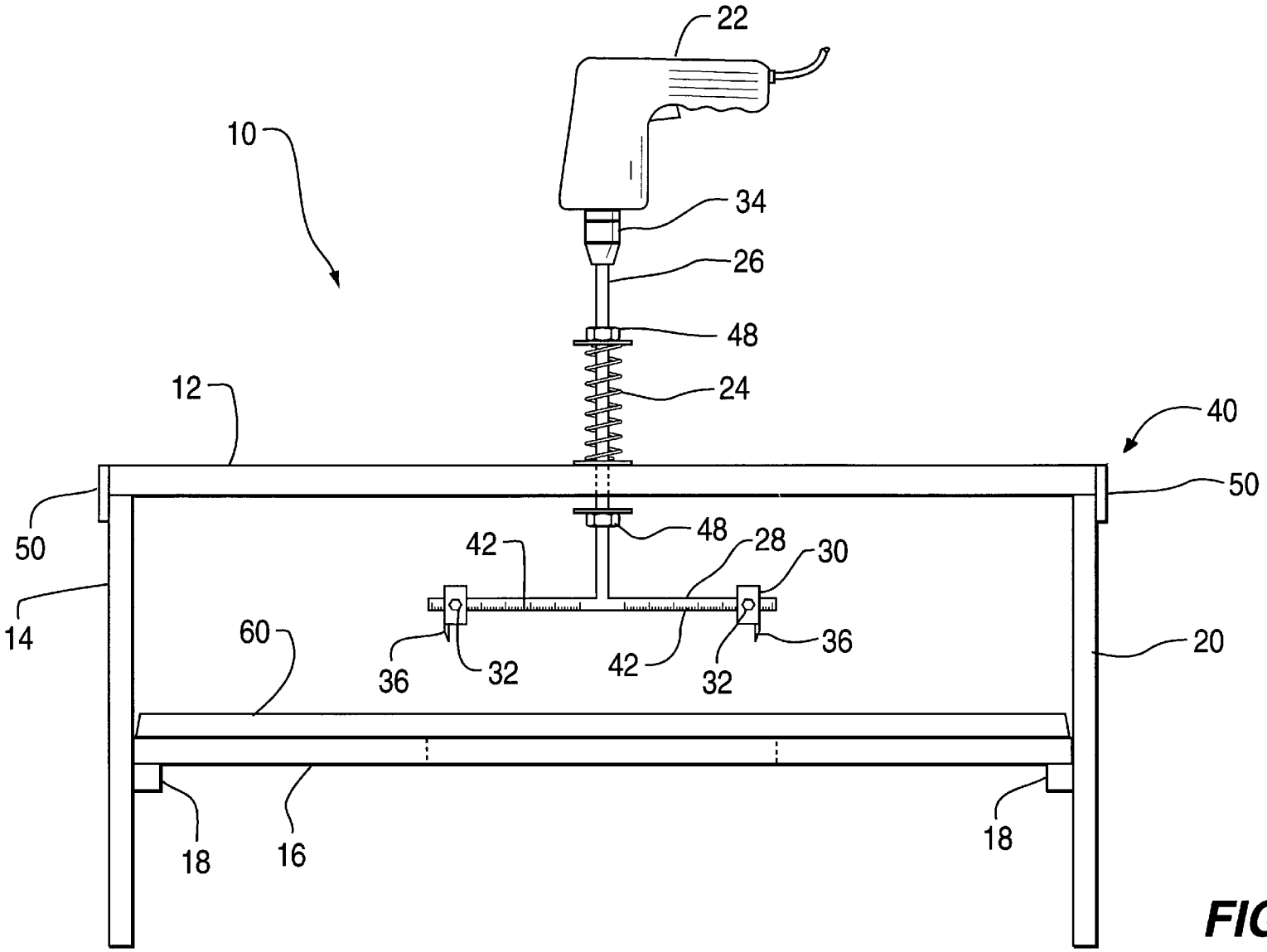
FIG. 1 is a partially cross-sectioned, side elevational view of the rotary cutter arranged for cutting a workpiece.
Figure 2:
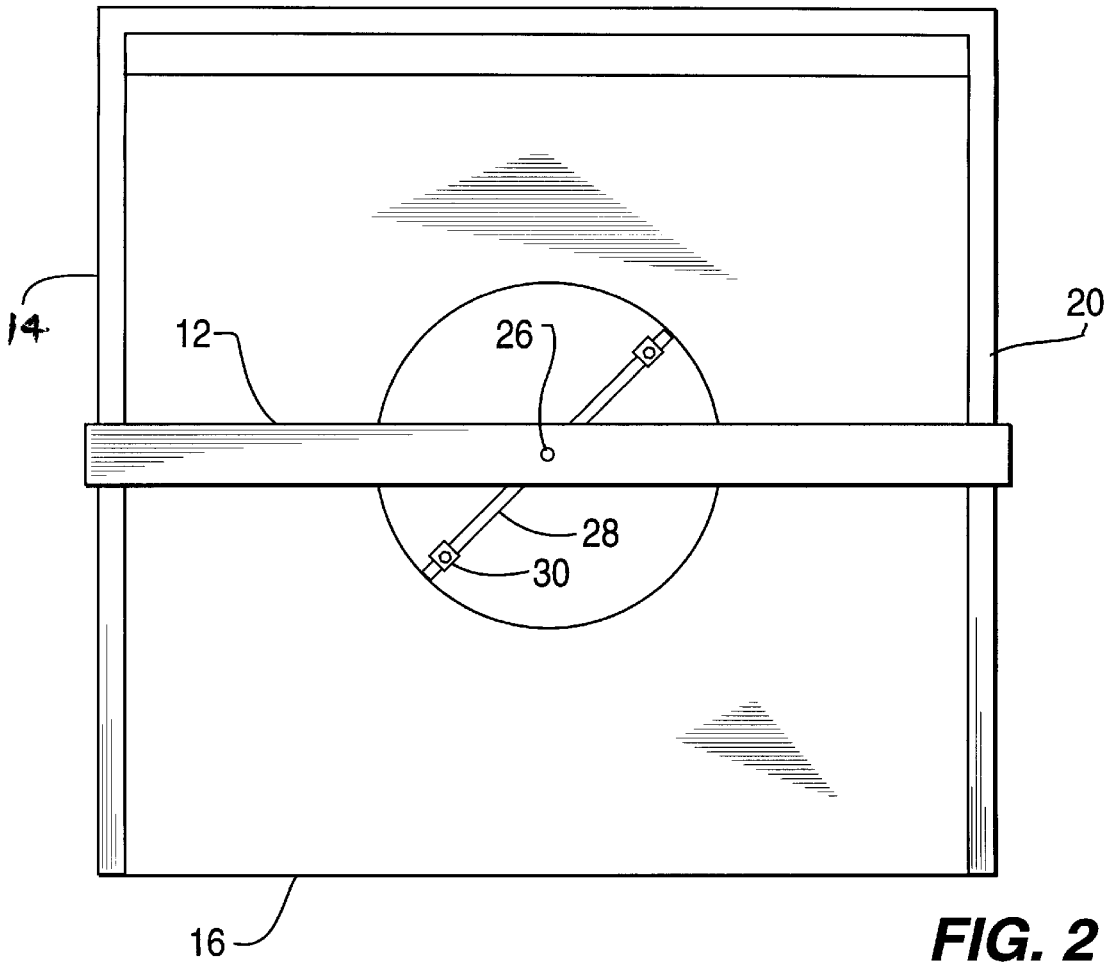
FIG. 2 is a view of a preferred embodiment of the rotary cutter.
Figure 3:
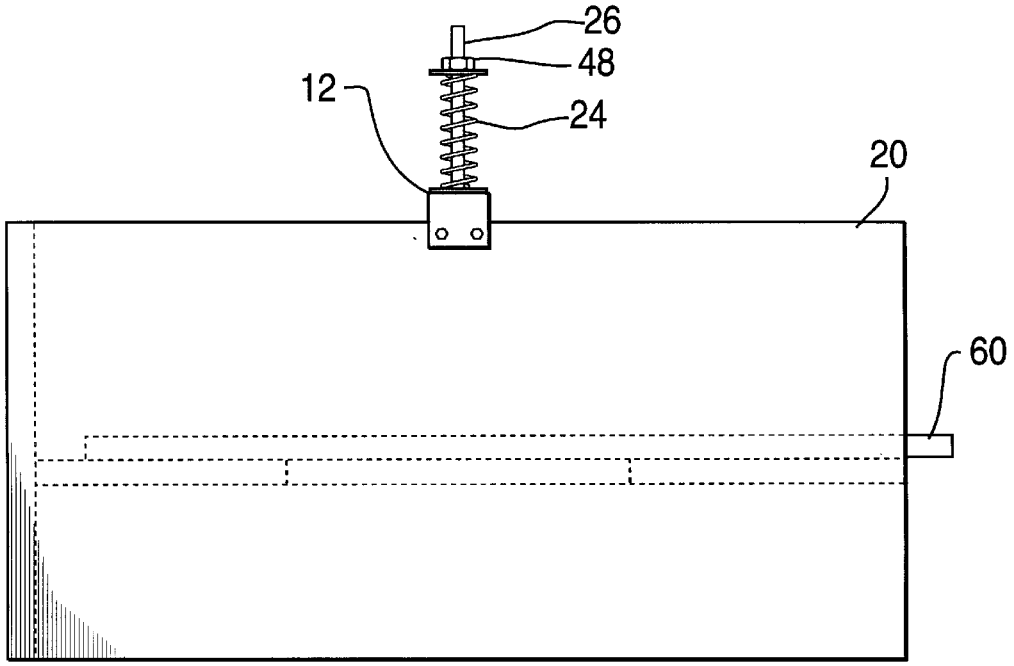
FIG. 3 is an end view of a preferred embodiment of the circular cutter.

Reference is now made to the drawings which illustrate a preferred embodiment of the improved rotary power cutter. The rotary cutter to be described herein is constructed from wooden parts except for the cutting blade itself, and these parts which define the cutter housing are held together by conventional nails or brackets. The cutter housing 40, is comprised of top metal channel member 12 and under side members 14, 20 and bottom member 16, which are held together by conventional nails or brackets. Channel member 12 consists of a 1 inch square metal beam fastened to side member 14, 20 by means of conventional brackets 50. Support members 18 provide additional support for bottom shelf 16. Ceiling tile piece 60 is positioned within cutter housing 40 by means of shelf members 16.

Rotary cutter 10 comprises drive shaft 26 held in a chuck 34 of a conventional drill 22 for purposes of rotating chuck 34 and shaft 26 integral with cutting arm 28. The specification and claims assume a vertically downward cutting orientation for rotary cutter 10 as best shown in FIG. 1, but the subject invention may also be operated horizontally or at some other orientation.

Drive shaft 26 engages compression spring 24 surrounding shaft 26 for biasing cutting arm 28 upward. Spring 24 is positioned on shaft 26 by means of retaining nuts 48.

Knife blades 36 are attached to cutting arm 28 by means of collar 30. Radial adjustment of knives 36 is accomplished by means of set screws 32 mounted in collar 30. A scale 42 is mounted on cutting arm 28 for purposes of achieving various radial adjustments for knives 36.

To make a cut with rotary cutter 10, the operator establishes the radii for the cut to be made by adjusting knives 36 by means of adjusting collars 30 and set screws 32 with reference to scales 42.

The operator then positions a ceiling tile 60 into housing member 40 which automatically enables the operator to locate the center of that ceiling tile. Hand drill 22 is then actuated so as to rotate shaft 26 and cutting arm 28 and knives 36 in a circular motion. Pressing the drill and shaft assembly downward advances knives 36 into workpiece 60 to complete the intended circular cut. After cutting blades 36 penetrate through workpiece 16 and bottom shelf 16, biasing spring 24 causes drive shaft assembly 26 and cutting arm 28 to retreat vertically to its original position.

Following the aforesaid cutting operation, workpiece 60 is removed from housing assembly 40 and another workpiece is reinserted for similar cutting. The circular cut from workpiece 16 falls in downward fashion into a collection pan or other similar container placed beneath shelf 16 to facilitate cleanup.

Compared with prior art methods, cutter 10 is fast, convenient and efficient in making circular cuts by automatically locating the center of an acoustic ceiling tile and achieving in one step a perfect round hole for the installation of recessed round high hat type light fixtures.

Whereas the invention has been described in conjunction with a preferred embodiment, it is to be appreciated that various modifications and arrangements may be made without departing from the spirit and scope of the invention as defined by the appended claims.

I claim:

1. A rotary cutting device for cutting apertures in acoustical ceiling tile comprising:

a housing assembly including:

a flat bottom member having a workpiece support surface thereon, two vertical side walls, and a mounting assembly comprising a metal bar, wherein the metal bar is attached to a top surface of each of said vertical side walls, wherein said bottom member is supported on said side walls, and wherein said side walls extend upwardly and downwardly from said bottom member;

rotary cutter means mounted on said housing assembly, said rotary cutter means including:

a rotor shaft extending through said metal bar, two blade arms carried by said rotor shaft and extending radially outward therefrom, said blade arms being disposed within said housing assembly, a collar slidably mounted on each blade arm, means for fixing each of said collars in position on the respective blade arm, a cutting blade mounted on each of said collars, the cutting blades being disposed within said housing assembly, a drill connected to said rotor shaft for imparting rotational movement thereto, a first retaining means on said rotor shaft above said metal bar, and a second retaining means on said rotor shaft below said metal bar and spaced above said blade arms; and a spring mounted on said rotor shaft between said metal bar and said first retaining means;

whereby said spring axially biases said rotor shaft upward so that said blade arms advance into cutting engagement with said ceiling tile by applying downward pressure to said rotary cutting means and compressing said spring, and said spring returns said blade arms to a position of non-cutting engagement upon releasing said downward pressure at the completion of the cutting operation.

2. The rotary cutter according to claim 1 wherein each blade arm contains a measurement scale located on its exterior surface for use in adjusting the radial positioning of the respective blade relative to said shaft for making different sized cuts in said ceiling tile.

* * * * *